US005858160A

United States Patent [19]

Piacente et al.

[11] Patent Number: 5,858,160

[45] Date of Patent: Jan. 12, 1999

[54] DECORATIVE SURFACE COVERINGS CONTAINING EMBOSSED-IN-REGISTER INLAIDS

[75] Inventors: Anthony N. Piacente, Lawrenceville; Milton J. Potosky, Hamilton Square, both of N.J.

[73] Assignee: Congoleum Corporation, Mercerville, N.J.

[21] Appl. No.: 287,182

[22] Filed: Aug. 8, 1994

[51] Int. Cl.[6] ..... B05B 31/00

[52] U.S. Cl. ..... 156/279; 156/277; 264/464; 264/54; 264/131; 264/132; 427/214; 427/219; 427/265; 427/272; 427/280; 427/373

[58] Field of Search ..... 161/119, 160, 161/161, 166, 165, 413, 159; 264/219, 45.1, 54, 230, 129, 134, 135, 136, 137, 131, 132, 46.4; 428/323, 79; 156/276, 220, 222, 277, 279; 427/197, 198, 214, 277, 278, 264, 219, 265, 272, 280, 373

[56] References Cited

U.S. PATENT DOCUMENTS

| | | | |
|---|---|---|---|
| 2,241,051 | 5/1941 | Berger . | |
| 2,961,332 | 11/1960 | Nairn . | |
| 3,081,698 | 3/1963 | Childres et al. . | |
| 3,084,136 | 4/1963 | Chapin et al. . | |
| 3,293,094 | 12/1966 | Nairn et al. . | |
| 3,293,108 | 12/1966 | Nairn et al. . | |
| 3,325,574 | 6/1967 | Stadden . | |
| 3,660,187 | 5/1972 | Shortway et al. . | |
| 3,870,591 | 3/1975 | Witman | 161/119 |
| 3,951,714 | 4/1976 | Franco . | |
| 3,978,258 | 8/1976 | Faust et al. | 428/159 |
| 4,126,727 | 11/1978 | Kaminski . | |
| 4,244,899 | 1/1981 | Henshaw . | |
| 4,248,922 | 2/1981 | Shortway et al. . | |
| 4,273,820 | 6/1981 | Swietzer | 428/159 |
| 4,277,424 | 7/1981 | Kaminski et al. . | |
| 4,278,483 | 7/1981 | Mansolillo . | |
| 4,294,786 | 10/1981 | Graham et al. . | |
| 4,298,646 | 11/1981 | Haemer et al. . | |
| 4,389,514 | 6/1983 | Schmidle et al. . | |
| 4,393,187 | 7/1983 | Boba et al. . | |
| 4,401,611 | 8/1983 | Mansolillo et al. . | |
| 4,456,643 | 6/1984 | Colyer | 428/156 |
| 4,483,732 | 11/1984 | Penta et al. | 156/247 |
| 4,491,616 | 1/1985 | Schmidle et al. | 428/158 |
| 4,504,523 | 3/1985 | Miller, Jr. et al. . | |
| 4,547,245 | 10/1985 | Colyer . | |
| 4,575,432 | 3/1986 | Lin et al. . | |
| 4,588,545 | 5/1986 | Kauffman et al. | 264/46.4 |
| 4,609,431 | 9/1986 | Grose et al. . | |
| 4,710,415 | 12/1987 | Slosberg et al. | 428/48 |
| 4,844,849 | 7/1989 | Miller et al. . | |
| 4,935,286 | 6/1990 | Witman . | |

*Primary Examiner*—Merrick Dixon
*Attorney, Agent, or Firm*—Synnestvedt & Lechner

[57] ABSTRACT

Disclosed are decorative surface coverings of the "inlaid" type having embossed patterns in register with inlaid patterns. Disclosed methods include the steps of: applying in a pattern on a first surface of a foamable layer an agent for modifying the foaming of said foamable layer to produce a foamable layer having a pattern of relatively nonfoamable areas and relatively foamable areas; applying a first collection of particulate resinous material substantially only to said areas containing said foaming modifier or only to said areas not containing said foaming modifier; and foaming said foamable layer in said relatively foamable areas.

26 Claims, 2 Drawing Sheets

DECORATIVE SURFACE COVERINGS CONTAINING EMBOSSED-IN-REGISTER INLAIDS

DECORATIVE SURFACE COVERINGS

The present invention relates to decorative surface coverings. More particularly, this invention is directed to inlaid decorative sheet materials useful as coverings for floors, walls and the like, and methods of making such decorative structures.

Inlaid coverings, and particularly inlaid floor coverings, are decorative sheet products characterized by a wear layer having certain decorative aspects which remain visually unchanged as the covering wears. Traditionally, inlaid resinous surface coverings include a wear surface comprising particles of resinous material, such as resinous chips, flakes, granules, beads or the like. According to one known method of forming such products, a decorative inlaid pattern or design is built-up by applying particulate materials of different colors and/or shapes in the desired pattern to a substrate or backing portion of the surface covering. The resinous material is then consolidated under heat and pressure to form a wear layer in which the decoration is carried substantially through the entire thickness of the wear layer. Such constructions are commonly referred to as "true inlaids."

According to certain more recent constructions, an inlaid characteristic is achieved by first applying a printed pattern to a substrate and then forming a matrix comprising adhesive and particulate material to the surface of the printed substrate. In such constructions, conventional ink printing is used to form the pattern, and such constructions are sometimes referred to as "pseudo inlaids." In such constructions, the resinous particulate is not necessarily consolidated by pressure, but may be incorporated into the wear layer by the application of heat alone. In either case, the decorative aspect provided by the resinous particulate is carried through the entire wear layer.

In many instances, inlaid wear layers comprising resinous particulate material are formed or applied over backings which provide support, strength and other beneficial properties to the surface coverings. Commonly employed backing materials include woven fabrics, paper, felt, metal, wood, glass, and the like. In addition, surface coverings are also known to include cellular resinous compositions as an underlayment for resinous wear layers. Such cellular materials may be used alone or in combination with other backing materials. Surface coverings containing such cellular materials are sometimes referred to as "foamed" products, and the foamed layer of such products may be used to provide various desirable properties, including high resiliency and good feel or "hand."

It is common practice to emboss the surface of floor covering products as a means for adding decorative appeal and, in many instances, further utility. Typical of the types of embossings are those which simulate leather, textured cloth, bricks, wood and other types of natural substances. In some instances, the embossed areas are filled in with pigmented ink by techniques known as "spanishing" or "valley printing."

Mechanical embossing of surface coverings has been conventionally accomplished with an engraved embossing roll or plate having the desired pattern or design in raised relief on its surface. The sheet and/or embossing surface is heated and the design pressed into the heat softened sheet. See, e.g., U.S. Pat. No. 4,277,424, Kaminski et al., col. 1, lines 31–36, which is incorporated herein by reference.

Applicants have recognized that difficulties may arise in connection with the production of surface coverings which concurrently posses both embossed features and inlaid, decorative effects. For example, it may be desirable in certain applications to produce a pattern of inlaid material which corresponds to or is "in register with" an embossed pattern. Such a construction may be achieved, for example, by depositing resinous particulate material in a desired pattern on a suitable substrate using a flat or rotary screen apparatus. After consolidation of the resinous particulate material, the embossed pattern is typically achieved by pressing the sheet between an embossing roll and a nip roll, which together control the extent of embossing. The embossing roll has a design or pattern corresponding to the design or pattern of the deposited particulate.

Regulation of the relative speeds of the embossing roll and the nip roll is also commonly used to control the registration of the embossing with the inlaid pattern. However, applicants have recognized that obtaining "registration" of the pattern on the embossing plate with the particle pattern is difficult to achieve due to the limitations of the equipment and process used for mechanical embossing. Particularly, applicants have recognized that the misregistration problems encountered in such prior processes are due in large part to the difficulty of making such registration adjustments at a point in the process after the inlaid layer has been sintered and/or consolidated. Furthermore, variation in temperatures and tensions across the web or sheet can produce misregistration between the embossed pattern and the inlaid pattern, and these difficulties increase dramatically as the width of the surface covering product increases.

Various methods have been suggested for producing cellular film products having a textured or embossed surface without utilizing embossing rolls. This has occurred, in part, because embossing rolls are expensive to produce and, when combined with a valley printing operation, are difficult to control.

A prior method which eliminates embossing rolls is taught in U.S. Pat. No. 2,961,332—Nairn. The Nairn patent teaches a layer of foamable resinous composition formed on a base by printing a number of different resinous compositions, each containing its own type and amount of blowing agent. This layer is then heated to decompose the blowing agent and fuse the composition. The products produced in accordance with U.S. Pat. No. 2,961,332—Nairn have an irregular or textured surface conforming to the amount or type of blowing agent in the various printed compositions.

The well known "chemical embossing technique" has produced vast improvements over prior chemical and other embossing techniques. Chemical embossing is taught in U.S. Pat. No. 3,293,094—Nairn et al. and U.S. Pat. No. 3,093,108—Nairn et al. These patents disclose that the decomposition temperature of a chemical blowing agent dispersed in a resinous polymer composition can be controlled by applying an inhibitor to a surface of the composition. The subsequent application of heat then selectively decomposes the blowing agent, thereby resulting in the formation of either depressed or raised areas in the final product, depending upon the points of inhibitor application. The teachings of both Nairn et al. patents are specifically incorporated herein by reference.

SUMMARY OF THE INVENTION

In view of the deficiencies of the prior art, it is an object of the present invention to provide efficient and effective methods of producing decorative surface coverings of the "inlaid" type having embossed patterns in register with inlaid patterns.

The present invention provides methods of forming highly desirable, embossed inlaid surface covering products. As the term is used herein, "inlaid" refers to surface covering materials in with a through patterned effect is incorporated into the wearlayer as a result of the patterned build-up of particulate material. The methods comprise: applying in a pattern on a first surface of a foamable layer an agent for modifying the foaming of said foamable layer to produce a foamable layer having a pattern of relatively nonfoamable areas and relatively foamable areas; applying a first collection of particulate resinous material substantially only to said areas containing said foaming modifier or only to said areas not containing said foaming modifier; applying a second collection of particulate material to the areas of the foamable layer not occupied by the first particulate material; consolidating the first and second collection of particles; and foaming said foamable layer in said relatively foamable areas. In accordance with further embodiments of the present invention, particulate material including the first and second collection of particles together substantially cover the foamable layer and form the wear surface of the flooring product.

The present invention also provides decorative inlaid surface coverings having an embossed pattern in register with an inlaid pattern. The products preferably comprise a foamed layer which has been treated with a modifying agent to modify the foaming thereof to produce a pattern of lands and valleys in a surface thereof, and an inlaid wear layer overlying foamed layer. In such embodiments, the first collection of particulate material is in register with the lands and the second collection is in register with the valleys.

DETAILED DESCRIPTION OF PREFERRED EMBODIMENTS

I. THE FOAMABLE LAYER

Figure 1:
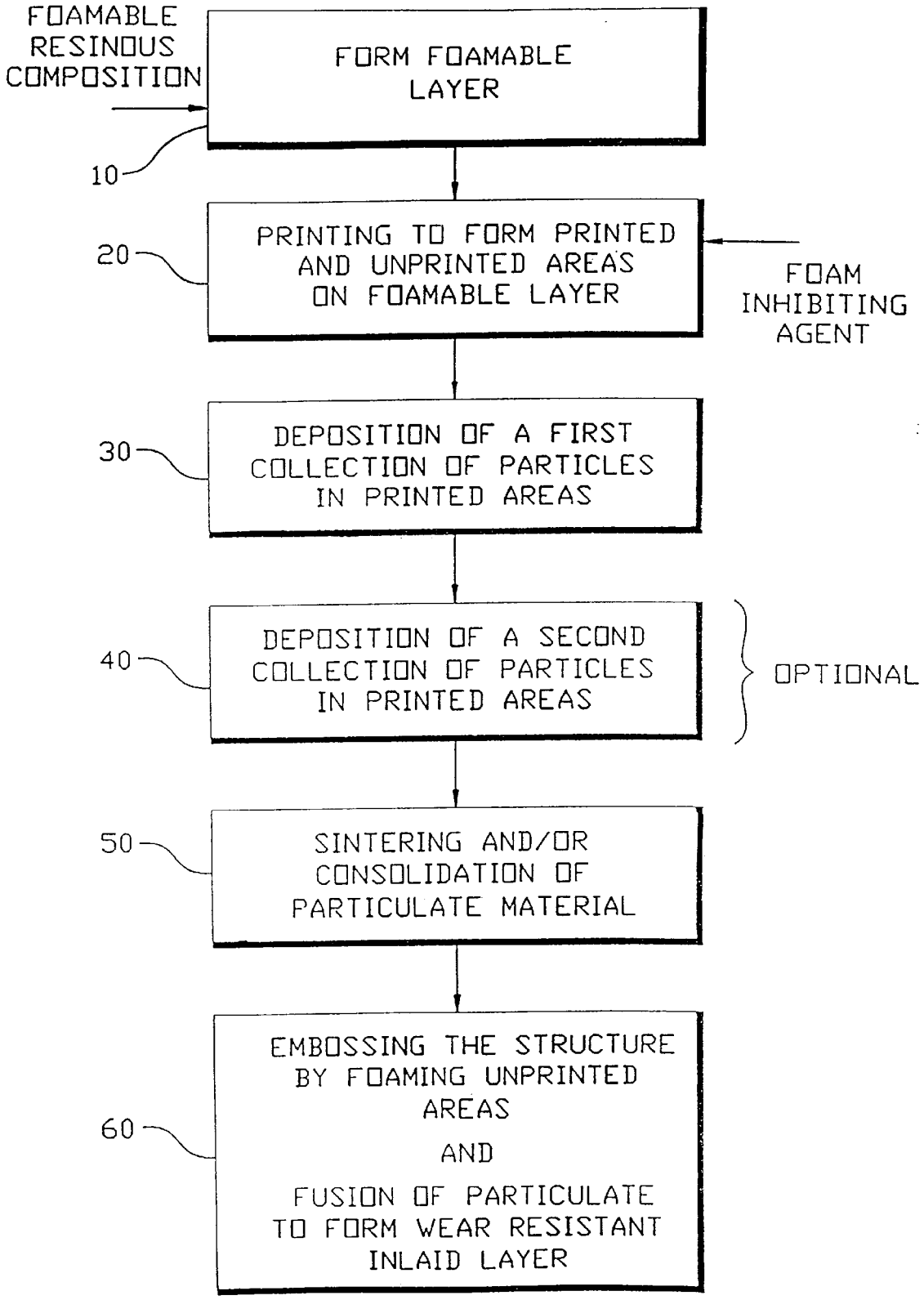
FIG. 1 is a flow chart of processes provided in accordance with one embodiment of the present invention.

The products and methods of the present invention require a foamable layer, as in the case of the method aspects or a foamed layer, as in the case of the product aspects. The foamable compositions and layers of the present invention are characterized by an ability to produce, after appropriate foaming steps, a blown or foamed, cellular structure.

Numerous types and variations of foamable layers are known and available to those skilled in the art, and all such layers are within the scope of the present invention. In general, however, the foamable layer of the present invention preferably comprises a foamable composition containing polyvinyl chloride (PVC) resin, and even more preferably a foamable PVC plastisol composition.

It will be appreciated that the foamable layer of the present invention may, in certain embodiments, be joined or adhered to an underlying, nonfoamable substrate or backing layer. In addition, the foamable layer may comprise two or more foamable layers joined together. The foamable and nonfoamable layers may be joined according to a wide variety of known techniques, including adhesive bonding, laminating and the like.

The nonfoamable substrate, when present, may be comprised of one or more nonfoamable materials conventionally used in the surface covering art. For example, the substrate may comprise: a matted or felted fibrous sheet; a woven and/or knitted fabric; a non-woven fabric; and/or substantially any type of relatively flat sheet material formed of mineral fibers, natural fibers of wool or of cellulosic origin, synthetic or man-made fibers or filaments such as rayon, nylon, polyester, polyolefins, asbestos, glass, wool, mineral or slag wool, metallic threads, and the like. Such a sheet material may be impregnated or saturated with a water-resistant, stain-resistant and/or strengthening impregnant, such as a vinyl resin, a phenolic resin, a butadiene-styrene resin or other thermoplastic, crosslinking or thermosetting resins.

The thickness of the nonfoamable substrate may vary widely depending upon the particular product and its contemplated application. Normally, however, it is preferred that the nonfoamable substrate have a thickness of from about 10 mils to about 90 mils, although substrate thicknesses greater than about 90 mils may be desirable in particular circumstances. While it is contemplated that all such substrates are adaptable for use according to the present invention, it is preferred that the substrate comprise felt, and even more preferably a non-asbestos felt impregnated with suitable sealing coats as are well known in the art. When the surface coverings of the present invention are adapted for use as wall coverings, a substrate comprising paper, sheet cloth, dental foil and the like is preferred.

The foamable layer of the present invention may be formed of any suitable, potentially foamable material known to those skilled in the art, and all such materials are within the scope of the present invention. In generally, it is preferred that the foamable layer comprise a dispersion or suspension of a synthetic resin in a liquid or semi-liquid carrier. The carrier may be water in the case of an aquasol or aqueous latex, or may be an organic solvent in the case of an organosol, or it may be a plasticizer in the case of a plastisol.

Plastisols are generally preferred because of the ease of handling of such materials and because the use of such materials does not require the subsequent removal of large volumes of carrier, such as water in the case of an aqueous latex or aquasol and organic solvents in the case of an organosol.

It is contemplated that the thickness of the foamable layer will vary widely depending upon the particular product to be made and the contemplated use thereof. In general, however, it is preferred that the thickness of such foamable layer, as applied, be in the range of from about 5 mils to about 50 mils, and even more preferably, from about 10 mils to about 20 mils. Such thicknesses are especially preferred when the foamable layer comprises a foamable PVC plastisol layer. In the fully foamed finished product, it is preferred that the thickness of the foamed layer be in the range of from about 5 mils to about 150 mils, and even more preferably, from about 30 mils to about 60 mils. Such thicknesses are especially preferred when the foamed layer comprises a foamed PVC plastisol layer. In general, the blow ratio of the present products is from about 1.5:1 to about 4:1, wherein blow ration is defined as the thickness of the foamed layer divided by the thickness of the foamable layer prior to foaming.

A. The Resins

Whether in the form of a latex, organosol or plastisol, the synthetic resin of the foamable layer preferably comprises vinyl polymer resin, and even more preferably vinyl chloride polymer resin, dispersed, dissolved, wetted, gelled or fused in the carrier. The vinyl chloride polymers can be simple, unmixed homopolymers of vinyl chloride or block copolymers, terpolymers or the like thereof in which the essential polymeric structure of poly(vinyl chloride) is interspersed at intervals with residues of the other ethylenically unsaturated compounds polymerized therewith. Furthermore, it is contemplated that mixtures and combinations of the above may be employed. It is contemplated that comonomers may include, for example: vinyl halides such as vinyl bromide and vinyl fluoride; vinyl esters such as vinyl acetate, vinyl chloroacetate, vinyl butyrate, other fatty acid vinyl esters, vinyl alkyl sulfonates and the like; vinyl ethers, such as vinyl ethylether, vinyl isopropyl ether, vinyl chloroethyl ether and the like; cyclic unsaturated compounds such as styrene, the mono- and poly-chloro styrenes, coumarone, indene, vinyl naphthalenes, vinyl pyridines, vinyl pyrrole and the like; acrylic acid and its derivatives such as ethyl acrylate, methyl methacrylate, ethyl methacrylate, ethyl chloroacrylate, acrylonitrile, methacrylonitrile, diethyl-maleate, diethyl fumarate and the like; vinylidene compounds, such as vinylidene chloride, vinylidene bromide, vinylidene fluorochloride and the like; unsaturated hydrocarbons such as ethylene, propylene, isobutene and the like; allyl compounds, such as allyl acetate, allyl chloride, allyl ethylether and the like; and conjugated and cross-conjugated ethlynically unsaturated compounds such as butadiene, isoprene, chloroprene, 2,3, dimethylbutadiene-1,3-piperylene, divinyl ketone and the like.

Although such vinyl chloride resins are preferred, it is contemplated that the present compositions may be formed using other polymeric material, and in its broadest sense the invention is not intended to be limited to any particular polymer or polymer groups since many other types and groups of polymers may be selected in view of the guidance of the present disclosure without undue experimentation. For example, the foamable layer may comprise polyolefins, such as polyethylene and polypropylene, acrylates and methacrylates, polyesters, polyamides, polystyrene, phenylic resins, polyurethanes, ureas, synthetic and natural rubber, urea formaldehyde, neoprene and the like.

B. The Carrier

The carrier portion of the material which comprises the foamable layer, and particularly carrier which comprises plasticizer, generally functions so as to increase the workability, flexibility and/or distensibility of the resinous portion of the preferred foamable layer. The liquid plasticizer of the plastisol or organosol forms of the present compositions is selected on the basis of its compatibility with the resin constituent of the composition, that is, its ability to produce a gel, and ultimately a fully fused, foamed solid, when the composition is heated. As is well known to those skilled in the art, plasticizers are generally high boiling, chemically and thermally stable organic liquids, low-melting solids or semi-solids. The plasticizers affect several properties of the present compositions. For example, the plasticizer can have an effect on the rheology of the present fluid plastisols compositions as well as on the strength and flexibility of the present fused plastisols. With the guidance provided herein, it is expected that those skilled in the art will be capable of selecting the plasticizer needed for any particular application without undue experimentation.

It is contemplated that the amount of carrier used in the foamable layer of the present invention can vary widely, depending upon such factors as the particular properties desired for the surface covering product. For embodiments in which the carrier comprises plasticizer, it is generally preferred, however, that the present compositions contain from about 20 to about 70 parts by weight of plasticizer per 100 parts by weight of resin, with about 30 to about 50 parts per hundred of resin being even more preferred. For embodiments in which the resin comprises vinyl chloride resin, the use of from about 40 to about 50 parts by weight of plasticizer per hundred parts by weight of resin is preferred.

The plasticizers of the present invention preferably comprise ester compounds such as monomeric phthalate esters, dibasic acid esters, trimellitates, phosphate esters and polyesters, with monomeric phthalate esters being the most preferred. Monomeric phthalate esters employed according to the present invention are preferably selected from the group comprising dibutyl phthalate (DBP), dibutoxy ethyl phthalate (DBEP), butyl benzyl phthalate (BBP), butyl octyl phthalate (BOP), dihexyl phthalate (DHP), dioctyl phthalate (DOP), diisooctyl phthalate (DIOP), dicapryl phthalate (DCP), dicapryldioctyl phthalate (DCOP), diisononyl phthalate (DINP), diisodecyl phthalate (DIDP), ditridecyl phthalate and mixtures of these. Dibasic acid esters used as plasticizers according to the present invention are preferably selected from the group comprised of adipate esters, azelate esters and sebecate esters, and mixtures of these. Adipate esters are preferably selected from the group comprising dioctyl adipates (DOA), diisononyl adipate (DINA), diisodecyl adipate (DIDA) and mixtures of these. The azelate esters are preferably selected from the group comprising dioctyl azelate (DOZ), diisooctyl azelate (DIOZ), di-n-hexyl azelate and mixtures of these. When sebecate esters are used, dibutyl sebecate, dioctyl sebecate, dibenzyl sebecate, butyl benzyl sebecate and mixtures of these are preferred. Phosphate esters used as plasticizers according to the present invention are preferably selected from the group comprising tricresyl phosphate, cresyl diphenyl phosphate, octyl diphenyl phosphate and mixtures of these.

It is also contemplated that glycol benzoates, glycol butyrates, citrates, isophthalates, and aliphatic and aromatic hydrocarbons and chlorinated hydrocarbons may also be used alone or in combination with those plasticizers described above.

The preferred plasticizer is a plasticizer mixture comprising: glycol butyrate, and preferably alkyl glycol butyrate; glycol benzoate, and preferably alkyl glycol benzoate; benzyl phthalate, and preferably alkyl benzyl phthalate; and aromatic and aliphatic hydrocarbons. According to especially preferred embodiments, the plasticizer is a plasticizer mixture comprising: alkyl glycol butyrate; alkyl glycol benzoate; alkyl benzyl phthalate; and aromatic and aliphatic hydrocarbons, and it is especially preferred that such mixture comprise from about 4 to about 38 parts by weight of alkyl benzyl phthalate per hundred parts of plasticizer mixture, and even more preferably about 4–5 parts.

C. The Blowing Agents

The provision of a foamable layer according to the present invention preferably comprises providing a layer or coating of foamable composition comprising resin and plasticizer, preferably in the form of a plastisol or organosol, together with a foaming or blowing agent. It will be appreciated that the foamable composition may be a layer of resinous composition having a blowing agent substantially uniformly distributed throughout its thickness, or a resinous layer in which the blowing agent is only in one portion or stratum thereof. A foamable composition of the latter type can be prepared, for example, by laminating or otherwise forming a foamable resinous layer containing blowing agent with a layer containing no blowing agent.

The blowing or foaming agents used in accordance with the present invention may be selected from a wide variety of such agents, such selection depending on costs, the type of binder resin being used, the decomposition temperature of the blowing agent, density, solvent type and other factors.

As disclosed in the prior art, and particularly in U.S. Pat. No. 3,293,094—Nairn et al., the choice of blowing agent must of course be interrelated with the choice of foaming modifier which is applied in a pattern to the surface of the foamable layer of the present invention. A variety of blowing agents is disclosed, for example, in the above-noted Nairn et al. patent at col. 11, line 42-col. 12, line 45. The Nairn et al. patent also discloses inhibitors which are effective with these blowing agents at col. 4, lines 14-col. 19, line 56.

Complex organic compounds which, when heated, decompose to yield an inert gas and leave residues which are compatible with the thermoplastic resin are preferred as blowing agents. Such materials have the property of decomposing over a narrow temperature range which is particularly desirable to obtain a good foam structure.

Typical blowing agents include substituted nitro compounds, such as p-toluene sulfonyl semicarbazide, azodicarbonamide, p,p'-oxybis-(benzene sulfonyl hydrazide), p,p'-oxybis-(benzene sulfonyl semicarbazide), azobisiso-butyronitrile, N,N'-dimethyl-N,N'-dinitrososterephthalate, diazoaminobenzene, N,N'-dinitrosospentamethylene-tetramine, aminoguanidine bicarbonate, p,p'-thio-bis-(benzene sulfonyl hydrazide), p,p'-diphenylmethane disulfonyl hydrazide, benzene m-disulfonyl hydrazide, benzene sulfonyl hydrazide, terephthalazide, benzazide, p-t butyl benzazide, phthalazide, isophthalazide, 1,3-diphenyltriazene, azo-hexahydrobenzonitrile, azodicarboxylic acid diethylester, naphthalene-1,5-disulfonyl hydrazide and biuret. Of these, azodicarbonamide and p-toluene sulfonyl semi-carbazide are preferred. p-Toluene sulfonyl simicarbazide, being available in the form of a fine white powder, is particularly preferred when a clear or color stable pigmented printable composition is desired.

Inorganic blowing agents may also be used. These include ammonium bicarbonate, sodium bicarbonate, sodium boron hydride and silicon oxyhydride.

Blowing agents suitable for the present invention must be decomposed an effective amount at a temperature at which the foamable layer is in a softened or slightly molten state and below the decomposition temperature of the thermoplastic resin used. As an illustration, with vinyl chloride polymers, a blowing agent decomposing between about 145° C. and about 235° C. can be used. In some embodiments, a combination of blowing agents may be used.

It is common practice to add accelerators or catalysts to the composition to accelerate the decomposition of the blowing agents, control the decomposition temperature and/or narrow the decomposition temperature range. Typical accelerators include organic, inorganic and organo metallic compounds, such as: dioctyl phthalate, dioctyl adipate, paraffin oil, calcium sulfate, magnesium sulfate, carbon black, stearic acid, barium stearate, stannous stearate, titanium oxide, citric acid, triethanol amine, dibutyl tin laurate, dibutyl tin bis isooctyl, thioglycolate, dibasic lead phosphite, dibasic lead stearate, dibasic lead phthalate and similar lead salts, zinc laurate, zinc oxide, zinc stearate, zinc carbonate, zinc octoate, zinc naphtholate, zinc dust and zinc mercaptobenzothiazole.

In addition, the foamable layer may include various stabilizers such as phenyl phthalate, dibasic lead phosphite and the like to reduce the harmful effects of light- and heat degradation. Pigments, such as titanium dioxide may also be included.

D. Providing the Foamable Layer

The step of providing the foamable layer may simply comprise obtaining a preformed foamable layer. According to certain embodiments, however, the foamable layer is provided by applying a foamable composition, and preferably a foamable PVC composition, to a backing or carrier web. For embodiments in which a nonfoamable substrate is not included, then the foamable layer of the present invention may be applied by a doctor blade or roll coated, or poured or cast or otherwise applied to a strippable or removable carrier web. Such a carrier web may comprise a steel belt, a rubber belt, release paper, felt or other fabric or material having a release surface thereon. Such a carrier web is usually stripped from the foamable layer, either before or after the foamable layer is foamed.

For embodiments in which a nonfoamable substrate is to be employed, then the foamable material is applied to the substrate by a doctor blade or roll coated or poured or cast or otherwise applied to the substrate. Such procedures are well known in the art, and all such procedures are within the scope of the present invention.

It is also generally preferred that the foamable layer comprise a printable, foamable layer. As is understood by those skilled in the art, potentially foamable PVC plastisol compositions may exist in one of a variety of physical states. For example, such PVC plastisol materials may be in the form of relatively viscous, coatable fluids. According to preferred aspects of the present methods, such a foamable, fluid PVC plastisol or organosol is first applied by coating or printing for example, and then gelled to form a relatively solid, printable layer. The processing steps and conditions used to obtain gelling of such PVC plastisol will depend upon the particulars of each individual construction, and all such steps and conditions are within the scope of the present invention. However, the gelling conditions should not be such as would cause substantial blowing or foaming of the layer.

According to preferred embodiments, providing the foamable layer comprises applying a fluid plastisol composition to the carrier web or backing sheet material, and then at least partially gelling the applied plastisol by heating. The gelling conditions should be under moderate gentle heat without blowing or foaming the layer. This can be accomplished, for example, by heating for a period of time of from about ½ minute to about 4 minutes at an elevated temperature of from about B 240° F. to about 400° F., but more normally commercially from about 290° F. to about 350° F., whereby the plastisol gels. Under such processing conditions, the foamable plastisol composition firms so that it can be more easily handled, printed or otherwise processed in subsequent operations. The elevated temperature, however, is not so high as to activate or to decompose the particular blowing or foaming agent which may be present as to cause blowing or foaming of the plastisol.

According to alternative embodiments, the foamable layer is provided by forming a foamable composition into a gelled, partially gelled, fused or partially fused sheet, by molding, extruding, calendaring and the like.

II. THE FOAMING MODIFIER

An important aspect of the surface covering products of the present invention resides in the provision of a decorative, embossed surface. Such a surface is provided, in part, by the use of methods which comprise the step of applying in a pattern on a first surface of the foamable layer an agent for modifying the foaming characteristics of the foamable layer. For the purpose of convenience, such a foamable layer which has received an application of modifier is sometimes referred to herein as "modified foamable layer."

Since the foaming modifier is applied in a pattern on the surface of the foamable layer, the extent of foaming during the subsequent foaming step will vary across the foamable layer depending upon the pattern in which the modifier is applied.

It is contemplated that the blowing modifier may act either to inhibit or to enhance the foaming of the underlying portion of the foamable layer. Those skilled in the art will appreciate that in either case, the application of such a modifier in a pattern will produce a pattern of modified and unmodified areas. As a result, the foamed product will contain relatively raised lands and relatively depressed valleys, with either the valleys or the lands corresponding to the pattern of the modifier. For embodiments in which the modifier is an inhibiting agent, the valleys will correspond to the pattern. For embodiments in which the modifier is an enhancing agent, the lands will correspond to the pattern. In either embodiment, an embossed pattern is produced.

According to preferred embodiments, the modifying agent is an agent for inhibiting the foaming of the underlying layer. The application of such a blowing inhibitor results in a pattern on the surface of the foamable layer having inhibited areas corresponding to the location that the modifier is applied and uninhibited areas corresponding to those locations in which the inhibitor has not been applied.

It is also contemplated that the present invention comprises the application of a modifying agent which comprises a blowing accelerator. In such embodiments, the application of such a blowing accelerator results in a pattern on the surface of the foamable layer having accelerated areas corresponding to the location that the modifier is applied and unaccelerated areas corresponding to those locations in which the accelerator has not been applied.

As used herein, the terms "inhibiting agent," "inhibitor" and the like refer to those agents which reduce the extent of foaming of the foamable layer, while the terms "accelerator," "accelerating agent" and the like refer to agents which increase the extent of foaming of the foamable layer. According to preferred embodiments, the inhibiting agent prevents or reduces decomposition of the blowing agent in the areas of the foamable layer contacted by the inhibitor, and the accelerating agent increases the extent of decomposition of the blowing agent in the areas of the foamable layer contacted by the accelerator. The manner in which the inhibitors and accelerators operate is not essential to the present invention, and the use of all inhibitors and accelerators is within the scope hereof. Many conventional modifying agents are believed to operate by altering the decomposition temperature of the blowing agent, and such modifying agents are generally preferred. For example, the inhibitor is believed to operate by reacting with the blowing agent to raise the decomposition temperature thereof. In this way, the foamable layer may be foamed by heating to a temperature sufficient to produce a cellular structure in the areas not contacted by the inhibitor while leaving the areas in contact with the inhibitor to be relatively less foamed. Numerous exemplary modifying agents adaptable for use according to the present invention are described in U.S. Pat. No. 3,293,094—Nairn, which is incorporated herein by reference.

Various method steps are contemplated for applying the modifying agent of the present invention to the underlying foamable layer. It is generally preferred that the modifying agent be applied as a component of a coating composition comprising the modifier and a carrier material. For example, it is apparent that the modifying agent may be included as a component of a printing ink composition of the type commonly employed in the manufacture of surface covering products. The printing ink composition which contains the modifier may be colored or uncolored, depending upon the particular design considerations involved. The modifier may be soluble or not in the carrier. If the modifier has no solubility or low solubility in the carrier, than it can be dispersed or suspended in the carrier. In either case, the modifier may be applied by using any of the conventional printing techniques, such as silk screen, offset and rotogravure. Thus, the modifying agent may be a constituent of a conventional printing ink.

According to one embodiment, the coating composition containing the modifier is applied by printing in a design or pattern on the gelled, foamable composition. According to alternative embodiments, the modifying agent, either alone or as a constituent of a printing ink, may be printed or otherwise applied to a supporting base or web. A foamable composition may then be applied over the modifying agent to form a foamable layer having a modifier in a pattern on a surface thereto. The base in such an embodiment may be, for example, a transfer sheet which is latter removed form the product.

It will also be appreciated by those skilled in the art that in certain embodiments, a non-foaming solid resinous polymer composition may be applied over a foamable composition, and the modifying agent applied on the surface of the non-foaming solid composition. During heating, the modifying agent will migrate through the nonfoamable layer and into the foamable layer. According to such embodiments, the concentration of applied modifying agent is preferably greater than that used in embodiments in which the modifier is applied directly to the foamable layer.

The preferred method of applying the modifying agent by printing on the foamable layer may be carried out according to any one of well know and accepted printing techniques and means. For example, printing may be accomplished by printing means such as a silk screen apparatus, a flat bed printing machine, a conventional gravure press, direct transfer printing or sublimation transfer printing. Such means are etched to print a design with a suitable ink on the surface of the gelled sheet. It will also be appreciated that the modifying agent of the present invention may be combined with ingredients conventionally found in printing inks, such as pigments and the like, if such is desired.

It will also be appreciated by those skilled in the art that the modifying agent of the present invention may be applied to the foamable composition while it is in the liquid state. In such embodiments, the methods of the present invention do not require first heating the foamable coating to gel the composition to make the system printable. One means of accomplishing this is by the application of the inhibitor to a base or release paper in the form of a design and then casting the liquid composition over the printed base. Another means is to apply the inhibitor directly on the liquid composition. This can be carried out, for example, by spraying, using stencils or other means to control the areas of application of the inhibitor. It is also contemplated that electrostatic printing with dry modifying agent may be accomplished by the use of silkscreens or the like which do not touch the liquid composition. A suitable apparatus for such electrostatic printing is disclosed in U.S. Pat. No. 3,081,698—Childres et al., which is incorporated herein by reference.

III. INLAID LAYER

An important and critical aspect of the present invention resides in the formation of an "inlaid" layer over the modified foamable layer. The methods comprise applying a particulate material in register with an embossed pattern in the foamed or foamable layer. According to preferred embodiments, the formation of this inlaid layer comprises applying in registry with the modified or unmodified areas of the foamable layer at least a first collection of particulate material. The first collection of particulate preferably comprises resinous particulate material, and even more preferably resinous particulate material in major proportion. According to certain preferred embodiments, the resinous material comprises particles of PVC resin, and even more preferably of PVC resin dry blend.

It is contemplated that the first collection of particulate material may comprise a large number of particles having different sizes, and/or shapes, and/or colors, and/or formulation, etc. In general, however, the second collection of particles exhibits or possesses one or more characteristics that identify the collection as compared to other collections, specifically the second collection referred to hereinafter. The first collection of particles is preferably a substantially homogenous blend of any such different particles which contribute to and together produce a characteristic appearance for the collection.

According to preferred embodiments, the formation of the inlaid layer further comprises applying to at least a portion of the area not occupied by the first collection a second collection of particulate material. This second collection of particulate material also preferably comprises resinous particulate material, and even more preferably comprises such resinous particulate material in major proportion. According to certain preferred embodiments, the resinous material of the second collection comprises particles of PVC resin, and even more preferably of PVC resin dry blend.

As with the first collection, the second collection of particles may comprise a large number of particles having different sizes, and/or shapes, and or colors, etc. In general, however, the second collection of particles exhibit characteristics that identify the collection as compared to the first collection. The second collection of particles is also preferably a substantially homogenous blend of any such different particles which contribute to and together produce a characteristic appearance for the collection. In this way an inlaid, embossed-in-register pattern may be formed without the use of embossing rolls or the like.

It will be appreciated that a wide variety of patterns and designs may be formed using the methods of this invention. For instance, the present methods are not limited to the use of first and second collections of particles, but may use third, fourth, etc. collections to expand the design potentials that are available. A floral design floor covering pattern may have five or more differently shaped or colored design elements, and it is contemplated that each such design element may comprise a different collection of particles. In this way, each collection of particles will have a characteristic that distinguishes it from the other elements such that each design element in the pattern produces a distinct appearance.

Although the particulate material of the present invention is preferably a resinous composition comprised in major portion of vinyl resin particles, it will be appreciated that other particulate material may desirably be included in any particular collection of particles. For example, mixtures of different types of resins may be employed. In addition, inorganic filler particles, such as calcium carbonate and the like, and particles of color pigment may also be included in any collection of particles. The resin particles which are used may comprise dry blend resin particles, pulverized, milled, ground or otherwise comminuted particles, and such particles may be screened and filtered to the desired shape and size.

Deposition of such particulate material in registry with the modified or unmodified areas of the foamable layer may be achieved by any one of several known deposition methods, and all such techniques are within the scope of the present invention. The particular techniques employed will depend upon various factors, including the particular characteristics and properties of the particulate material being used. For example, the particulate material may be applied to the modified foamable layer by depositing the particulate through stencil openings having the desired pattern or design. Such conventional stenciling techniques are well known, as disclosed, for example in U.S. Pat. No. 2,241,051 and others. Modifications of such basic stenciling techniques are also adaptable for use in accordance with the present invention. For example, U.S. Pat. No. 3,325,574 discloses adding plasticizer to the particulate material in order to improve the definition of the resulting patterns. It is contemplated that such a process is adaptable for use in accordance with the present invention. The particular technique used to apply the particulate to the modified foamable layer will depend, at least in part, on the type of technique used to deposit the modifying agent onto the foamable layer. For example, if the modifying agent is applied using a rotary screen printing technique, it is contemplated that a continuous cylindrical stencil can be used with benefit. If a flatbed screen printing apparatus is used to apply the modifying agent, then it is contemplated that a flatbed stencil technique will be used to deposit the particulate material.

According to certain preferred embodiments, the modifying agent is incorporated into a printing ink composition which is applied in the desired pattern using a gravure printing press, and even more preferably a rotogravure printing press. In embodiments in which a rotogravure printing press is used, the particulate material will preferably be deposited using a rotary stencil or screen.

Formation of the inlaid layer also generally comprises further processing such deposited particulate so as to form a unitary, inlaid layer. In accordance with preferred embodiments, such processing includes exposing the particulate material to temperature and pressure conditions effective to consolidate the particulate material. This step may comprise sintering the particulate, which is preferably carried out at a temperature which is below the decomposition or foaming temperature of the foamable layer. The consolidation step further preferably comprises exposing the sintered particulate to pressures effective to consolidate the particulate into a relatively firm, partially fused inlaid layer. It is also contemplated that the application of pressure take place simultaneous with or subsequent to the sintering step. For embodiments in which the application of pressure occurs subsequent to sintering, it is contemplated that planisher rolls may be used for applying the pressure to the sintered particulate. For embodiments in which sintering and pressure application take place substantially simultaneously, it is contemplated that one or more of several types of equipment may be used. For example, a double bed press and/or a heated drum supplied with pressure applying means, such as pressure rolls and/or steel or fabric pressure belts, may be used. After consolidation, the inlaid layer is preferably fully fused by exposing the consolidated particles to heat. It is contemplated that techniques commonly used and available in the art for forming a fused inlaid layer are adaptable for use in accordance with the present invention. Those skilled in the art will appreciate that preferred fusion techniques include heating the layer under time and temperature conditions effective to form a durable, wear-resistant layer.

An important aspect of the present invention relates to the formation of an inlaid product in which embossing is present in register with at least a portion of the inlaid pattern. Creating such an embossed effect is achieved as a result of processing the foamable layer so as to produce a foamed layer therefrom. In general, it is contemplated that this foaming step will occur prior to complete fusion of the overlying inlaid wearlayer, although it will be understood that foaming can occur substantially simultaneously with fusion or even after fusion occurs.

The foaming step preferably comprises heating the foamable layer under time and temperature conditions so as to activate the blowing agent contained within the foamable layer. It is contemplated that in many embodiments the same equipment which is used to fuse the inlaid wearlayer will also achieve foaming of the foamable layer. More particularly, as the floor covering material is processed so as to increase the temperature to the fusion temperature, the foamable layer will generally first be exposed to time and temperature conditions which result in foaming of such layer. It is preferred that the floor covering is further heated after foaming has occurred so as to achieve a fully fused inlaid wearlayer.

In optional but preferred embodiments, the inlaid wearlayer may be coated with a relatively thin topcoat or sealcoat, such as polyurethane, which enhances the durability and gloss of the floor covering material.

As is seen from the above description, the present invention provides enormous flexibility and numerous options for achieving a wide variety of aesthetically pleasing floor covering designs, and all such combinations are contemplated to be within the scope of the present invention. According to certain embodiments in which the floor covering design simulates a pattern of bricks or tiles separated by grout areas, it is generally preferred that the modifying agent of the present invention is an inhibiting agent which reduces the extent of foaming of the foamable layer in a pattern corresponding to the grout and the unmodified areas correspond to the bricks or tiles. In such embodiments, it is also generally preferred that the inlaid layer covers substantially the entire extent of the floor covering to produce a unitary inlaid layer. Such a layer preferably comprises at least a first collection of particles overlying the inhibited areas and at least a second collection of particles overlying the uninhibited areas. According to such embodiments, a floor covering product is produced having relatively raised land areas containing an inlaid layer comprising a first collection of particulate material and relatively depressed valley areas which do not contain said first particulate material but instead contain a second collection of particulate material. Applicants have found that such products are not only aesthetically pleasing, but are also formed in a highly efficient, relatively cost-effective manner. This is achieved, in part, because the need for complex embossing rolls which emboss in registry with a preprinted pattern are eliminated. Such embossing equipment is not only expensive, but the use of such equipment according to prior art processes produced significant quantities of unacceptable floor coverings due to the difficulty of obtaining perfect registry between the embossing roll and the printed pattern. Such difficulties and problems are overcome by the products and methods of the present invention.

IV. EMBODIMENTS ILLUSTRATED IN THE FIGURES

Referring now to the drawings wherein like reference numerals refer to like elements, FIG. 1 is a flow chart of a preferred embodiment of methods to produce inlaid flooring in accordance with the present invention. At step 10 of the preferred method, a base layer comprising a foamable layer is formed, preferably by coating a surface of a substrate such as a woven fabric, paper, felt, metal, wood, glass and the like, with a foamable PVC plastisol.

At step 20, a printed pattern, and preferably a geometric pattern, is formed on the foamable base layer. The material used to form the pattern contains a foam inhibiting agent. At step 30, a first collection of granules, chips or flakes of a plastic resinous material, preferably PVC resin particles, is deposited in register with the unprinted areas. These particles may be of a first color, and/or a first shape and/or a first resinous material. At step 40, a second collection of resinous particles is deposited in the printed areas such that the first and second collection together substantially cover the surface of the foamable base layer. This second collection of particles may be of a second color, and/or shape and/or resinous material, provided that at least some characteristic of the second collection distinguishes it from the first collection of particles. The second, third, fourth, etc. collection of particles, when present, provides additional design flexibility and options, and may further enhance the wearability of the flooring structure.

At step 50, the particulate material is sintered and consolidated under heat and pressure. At step 60, the temperature of the flooring structure is then raised to foam the unprinted areas of the base layer, thereby producing an embossed product in which the surfaces of the raised portions are in register with the first collection of particles. Step 50 also preferably comprises fully fusing the sintered and consolidated collection of particles. As will be understood by the those skilled in the art, the foaming and fusing operations are frequently and preferably carried out at substantially the same time by heating the sintered and consolidated particles in what is known as a fusion oven. More specifically, the sintered and/or consolidated layer is exposed at step 60 to time and temperature conditions sufficient to cause first foaming and then fusion of the particulate and thereby form a wear-resistant inlaid layer.

Figure 2A:
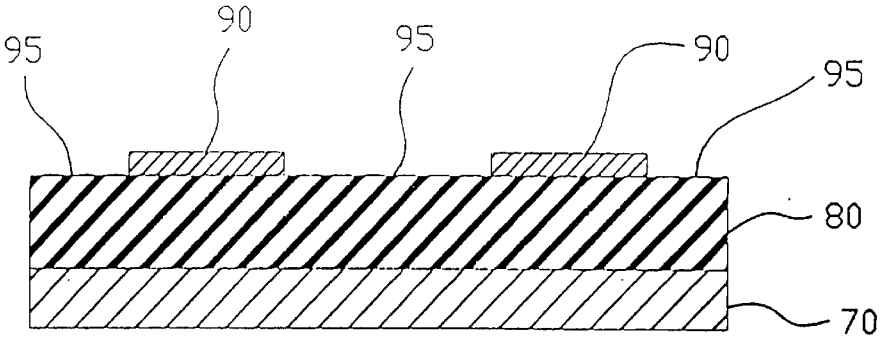
FIGS. 2A through 2C are schematic views of the various stages of producing a product made in accordance with one embodiment of the present invention.
Figure 2C:
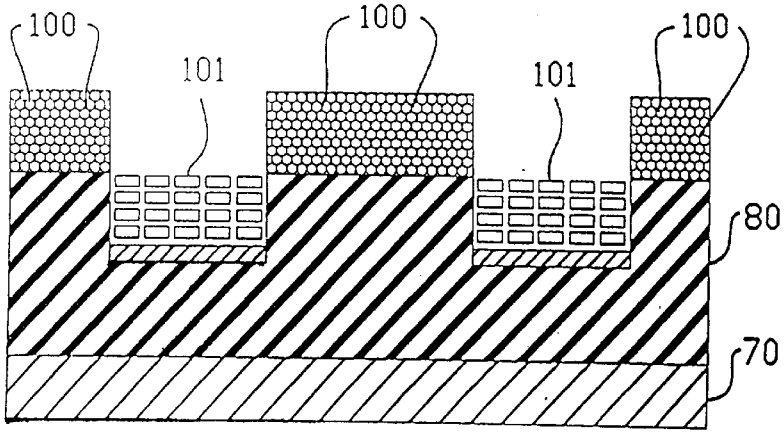
Figure 2B:
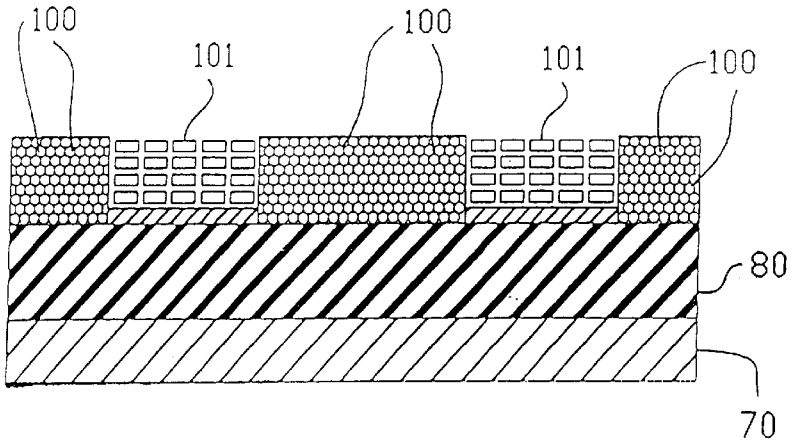

Referring now to FIGS. 2A through 2C, cross-sectional views of a flooring structure provided in accordance with preferred aspects of the present invention in various stages of manufacture are shown. It will be appreciated by those skilled in the art that the layers shown in these figures are not necessarily shown to scale and that the relative thicknesses of the layers in actuality will vary significantly from those shown in the figures. The layers are shown as they are for the convenience of illustration only.

With particular reference to FIG. 2A, substrate 70 is substantially coated with a foamable composition to produce a foamable layer 80. Printing ink 90 containing a foaming inhibitor is then laid down on the base layer in any desired pattern. At this stage of the preferred process, the foamable layer 80 contains inhibited areas underlying ink layer 90 and a pattern of uninhibited areas 95. Granules or chips 100 of a first collection of resinous material are applied to the foamable layer 80 in the uninhibited areas 95. A second collection of resinous particles 101 is applied to the inhibited areas 90. For the purpose of convenience and illustration only, but not by way of limitation, the first collection of particles is depicted in the figures as comprising spherically shaped particles while the second collection of particles is depicted as comprising relatively flat chips or flakes. The first and second collection of particles are then consolidated under heat and pressure to produce inlaid areas on the flooring structure. The temperature of the composite is then raised to foam the foamable layer and fuse the particle layer 100/101. As is illustrated, the unprinted areas 95 have undergone a greater degree of expansion than the printed areas 9, thereby producing an embossed product as shown in FIG. 2C.

It will be appreciated that, in the embodiments shown in the FIGS. 2A–2C, the area of foamable layer 80 underlying inhibitor ink 90 may foam or expand to a degree, and that the present invention only requires that such regions remain less foamed relative to the areas underlying particles 100. Similarly for embodiments in which an accelerator is used as the modifying agent, the area of the foamable layer which does not underlie the accelerator may foam or expand to a degree, and that the present invention only requires that such regions foam to a lesser degree than the areas underlying the accelerator. As stated above, additional collections of granules or chips can be optionally deposited to provide further enhanced appearance, skid-protection, wearability and the like.

The chemical embossing technique described above and the resultant product made in accordance with the present invention greatly improve the efficiency and economy of producing decorative inlaid structures. Such results have not heretofore been achieved in the art and greatly increase the economic viability of producing such structures. Although the present invention is most readily suitable for use in the manufacture of multilayered sheeting designed especially for use as floor coverings, it will be recognized by those with skill in the art that the invention can also be used to manufacture other types of multilayered sheeting prepared from compositions of the type that are particularly useful for a variety of different products, such as, for example, wall and ceiling coverings, and table, desk and countertop surfaces.

What is claimed is:

1. A method of making an embossed surface covering product comprising:

(a) providing a foamable layer;

(b) applying in a pattern on a first surface of said foamable layer a modifying agent for altering the foaming of said foamable layer to produce a foamable layer having modified areas corresponding to said pattern and unmodified areas not corresponding to said pattern;

(c) applying a first collection of particulate material in about said modified areas or in about said unmodified areas; and (d) foaming said foamable layer to produce a foamed layer having an embossed surface corresponding to the modified areas or to the unmodified areas of said foamable layer.

2. The method of claim 1 wherein said providing step comprises coating a layer of foamable PVC plastisol onto a nonfoamable substrate.

3. The method of claim 2 wherein said PVC plastisol comprises a blowing agent.

4. The method of claim 1 wherein said applying said modifying agent comprises applying a fluid composition containing said modifying agent.

5. The method of claim 4 wherein said applying step comprises applying a printing ink composition containing said modifying agent.

6. The method of claim 5 wherein said printing ink composition is a composition comprising PVC plastisol.

7. The method of claim 1 wherein said step of applying said modifying agent comprises printing a composition comprising PVC plastisol and said modifying agent onto said foamable layer.

8. The method of claim 1 wherein said step of applying a modifying agent comprises applying an inhibitor for inhibiting the foaming of said foamable layer to produce a foamable layer having inhibited areas corresponding to said pattern and uninhibited areas not corresponding to said pattern.

9. The method of claim 8 wherein said foamable layer comprises a foamable PVC plastisol containing a blowing agent.

10. The method of claim 9 wherein said step of applying first particulate material comprises applying said first particulate material only in about said uninhibited areas.

11. A method of making an embossed surface covering product comprising:

(a) providing a foamable layer;

(b) applying in a pattern on a first surface of said foamable layer an inhibiting agent for inhibiting the foaming of said foamable layer to produce a foamable layer having valley areas corresponding to said pattern and land areas not corresponding to said pattern;

(c) applying a first collection of particulate material in about said inhibited areas and not in about said uninhibited areas; and (d) foaming said foamable layer to produce a foamed layer having an embossed surface with valleys corresponding to the inhibited areas.

12. The method of claim 11 wherein said providing step comprises coating a layer of foamable PVC plastisol onto a nonfoamable substrate.

13. The method of claim 11 wherein said PVC plastisol comprises a blowing agent.

14. The method of claim 11 wherein said applying said inhibiting agent comprises applying a fluid composition containing said inhibiting agent.

15. The method of claim 14 wherein said applying step comprises applying a printing ink composition containing said inhibiting agent.

16. The method of claim 15 wherein said printing ink composition is a composition comprising PVC plastisol.

17. The method of claim 11 wherein said step of applying said inhibiting agent comprises printing a composition comprising PVC plastisol and said inhibiting agent onto said foamable layer.

18. The method of claim 17 wherein said foamable layer comprises a foamable PVC plastisol containing a blowing agent.

19. A method of making an embossed surface covering product comprising:

(a) providing a foamable layer;

(b) applying in a pattern on a first surface of said foamable layer an enhancing agent for enhancing the foaming of said foamable layer to produce a foamable layer having land areas corresponding to said pattern and valley areas not corresponding to said pattern;

(c) applying a first collection of particulate material in about said enhanced areas and not in about said unenhanced areas; and (d) foaming said foamable layer to produce a foamed layer having an embossed surface with lands corresponding to about the enhanced areas.

20. The method of claim 19 wherein said providing step comprises coating a layer of foamable PVC plastisol onto a nonfoamable substrate.

21. The method of claim 19 wherein said PVC plastisol comprises a blowing agent.

22. The method of claim 19 wherein said applying said enhancing agent comprises applying a fluid composition containing said enhancing agent.

23. The method of claim 22 wherein said applying step comprises applying a printing ink composition containing said enhancing agent.

24. The method of claim 23 wherein said printing ink composition is a composition comprising PVC plastisol.

25. The method of claim 19 wherein said step of applying said enhancing agent comprises printing a composition comprising PVC plastisol and said enhancing agent onto said foamable layer.

26. The method of claim 19 wherein said foamable layer comprises a foamable PVC plastisol containing a blowing agent.

* * * * *